US011338306B2

(12) United States Patent
Ning et al.

(10) Patent No.: US 11,338,306 B2
(45) Date of Patent: May 24, 2022

(54) SHOWERHEAD

(71) Applicant: XIAMEN SOLEX HIGH-TECH INDUSTRIES CO., LTD., Xiamen (CN)

(72) Inventors: Ruosheng Ning, Xiamen (CN); Fengde Lin, Xiamen (CN); Wenxing Chen, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 258 days.

(21) Appl. No.: 16/430,690

(22) Filed: Jun. 4, 2019

(65) Prior Publication Data

US 2019/0366357 A1 Dec. 5, 2019

(30) Foreign Application Priority Data

Jun. 5, 2018 (CN) ..... 201810569506.2

(51) Int. Cl.

| | |
|---|---|
| ***B05B 1/18*** | (2006.01) |
| ***B05B 15/50*** | (2018.01) |
| *E03C 1/08* | (2006.01) |

(52) U.S. Cl.

CPC ..... *B05B 1/18* (2013.01); *B05B 15/50* (2018.02); *E03C 1/08* (2013.01)

(58) Field of Classification Search

CPC .. B05B 1/18; B05B 1/185; B05B 1/26; B05B 1/265; B05B 1/28; B05B 1/3006;

(Continued)

(56) References Cited

U.S. PATENT DOCUMENTS

| | | | | |
|---|---|---|---|---|
| 3,640,472 | A * | 2/1972 | Hruby, Jr | B05B 1/3402 239/552 |
| 2013/0001324 | A1 | 1/2013 | Miedzius | |
| 2015/0196927 | A1* | 7/2015 | Ramos De Barros | B05B 1/18 239/107 |

FOREIGN PATENT DOCUMENTS

| | | | |
|---|---|---|---|
| CN | 203935930 | U | 11/2014 |
| EP | 2767347 | A1 | 8/2014 |
| WO | 2014019046 | A1 | 2/2014 |

OTHER PUBLICATIONS

The EESR issued Dec. 12, 2019 by the EPO.

* cited by examiner

*Primary Examiner* — Qingzhang Zhou
*Assistant Examiner* — Juan C Barrera
(74) *Attorney, Agent, or Firm* — Qinghong Xu

(57) ABSTRACT

This disclosure relates to a showerhead including a body, a stationary plate, a spring, and an insert fitting member. The body has an upper body and a lower body. The upper body and the lower body form an accommodation space. A water inlet for supplying water into the accommodation space is provided at the upper body, and a plurality of water outlets for spraying water from the showerhead are provided on the lower body. The stationary plate is located in the accommodation space and movable up and down in the accommodation space along a direction of the water flow. The spring is disposed between the stationary plate and the lower body, for applying a force to the stationary plate away from the lower body. The insert fitting member is fitted to the stationary plate. The position of the insert fitting member corresponds to the plurality of water outlets on the lower body. When the water is supplied, the stationary plate moves to a lower position under the action of water pressure, and the insert fitting member partially closes the water outlet to (Continued)

form a drizzle-type spray; and when the water is turned off, the spring pushes the stationary plate back to the upper position, and the water outlet plug leaves the water outlet.

9 Claims, 5 Drawing Sheets

(58) Field of Classification Search
CPC ... B05B 1/3033; B05B 1/3073; B05B 1/3086; B05B 15/52; B05B 15/522; B05B 15/5223; B05B 15/5225; E03C 1/08–086
USPC ..... 239/106
See application file for complete search history.

SHOWERHEAD

CROSS-REFERENCE TO RELATED APPLICATIONS

This application is related to, and claims the benefit of priority of, CN Application No. 201810569506.2, entitled SHOWERHEAD, filed on Jun. 5, 2018, the contents of which are incorporated herein by reference in their entirety for all purposes.

TECHNICAL FIELD

This disclosure relates to a showerhead, and more particularly to a showerhead capable of forming a special spray and capable of automatically removing impurities.

BACKGROUND

A showerhead is a nozzle used for a shower. The showerhead usually has multiple water outlet holes to create a special water outlet effect so as to improve user's experience. Due to complicated water path of the showerhead, impurities in the water are likely to remain in the showerhead, especially at the water outlet of the showerhead. Those remained impurities are usually difficult to be cleared, so it is necessary to design a showerhead convenient for cleaning the impurities.

In this regard, it is necessary to propose a showerhead that can overcome the above problem.

SUMMARY

It is an object of the present disclosure to provide a showerhead that is capable of solving the above problems.

According to the present disclosure, a showerhead includes: a body, including an upper body and a lower body, the upper body and the lower body forming an accommodation space, and a water inlet for supplying water into the accommodation space being provided at the upper body, a plurality of water outlets for spraying water from the showerhead being provided on the lower body. The showerhead further includes: a fitting plate located in the accommodation space and movable up and down along the direction of the water flow in the accommodation space; a spring disposed between the fitting plate and the lower body for applying a force to the fitting plate away from the lower body; an insert fitting member fitted to the fitting plate, a position of the insert fitting member corresponding to the plurality of water outlets on the lower body; when the water is supplied, the fitting plate moves to a lower position under the action of water pressure to allow the insert fitting member to partially close the water outlet such that a drizzle-type spray is formed; when the water is turned off, the spring pushes the fitting plate back to the upper position, and the water outlet plug leaves the water outlet.

BRIEF DESCRIPTION OF THE DRAWINGS

Hereinafter, exemplary embodiments of the present disclosure will be described in detail below with reference to the accompanying drawings, in order to facilitate those skilled in the art to understand the embodiments of the present invention with reference to the accompanying drawings, in which.

LIST OF REFERENCE NUMBERS

Figure 1:
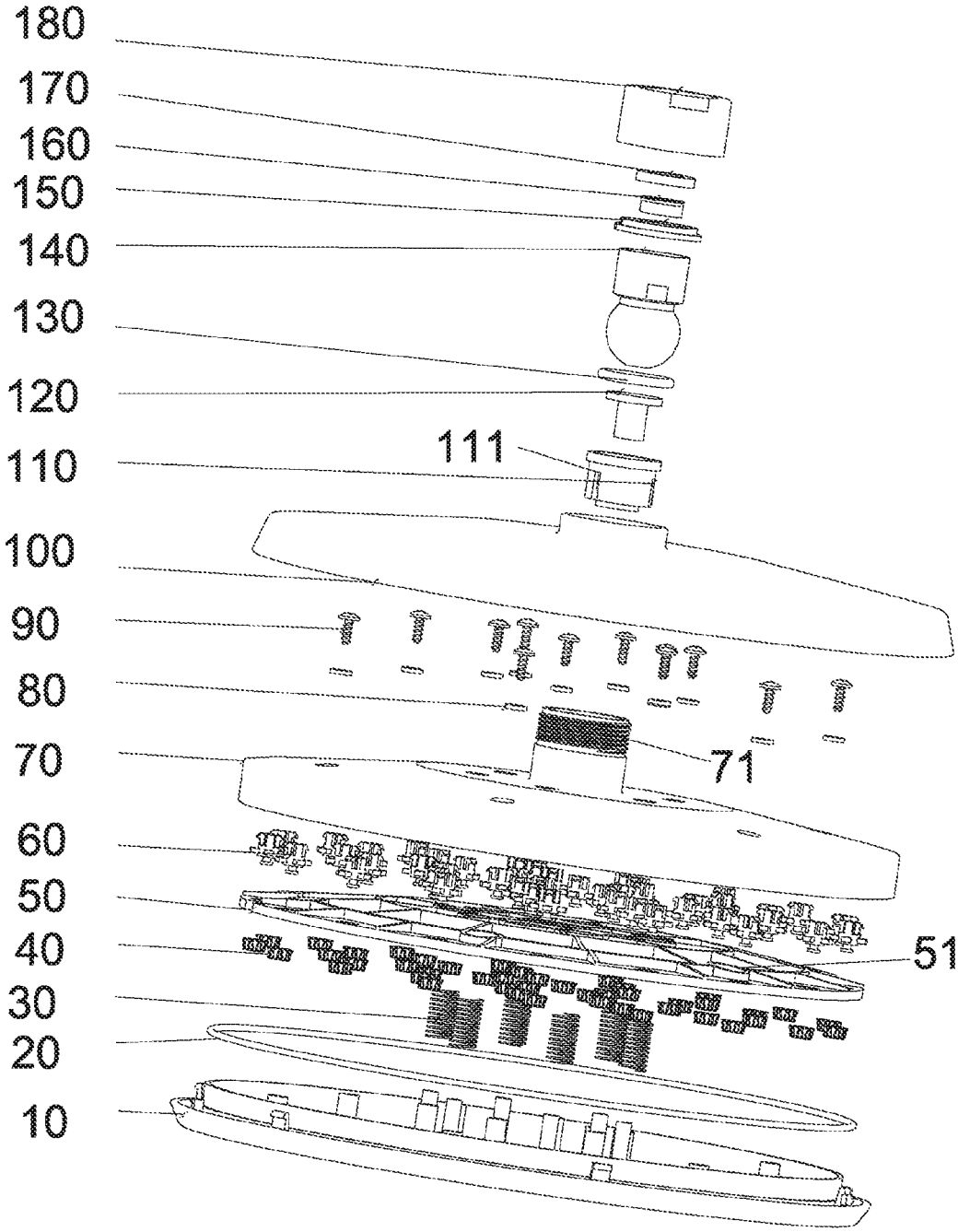
FIG. 1 is an exploded view of the showerhead in accordance with the present disclosure.

10 lower body
- 11 water outlet
- 12 enlarged portion

20 gasket
30 spring
40 water outlet plug
41 lip
- 42 longitudinal groove
- 43 circumferential groove
- 44 depression
- 45 side wall
- 46 bottom wall

50 fitting plate
- 51 fitting plate hole

60 connector
- 61 enlarged diameter portion
- 62 elastic clamp
- 63 joint
- 64 snap mating portion

70 upper body
80 sealing washer
90 screw
100 upper decorative cover
110 water outlet body
- 111 water outlet groove

120 pusher
130 ball joint washer
140 ball joint
15 boss
- 151 upper end surface of boss

150 bushing
160 restrictor sheet
170 screen gasket
180 showerhead nut

DETAILED DESCRIPTION

Although the present disclosure has been illustrated and described herein with reference to these specific embodiments, the present disclosure should not be limited to the disclosed details. Rather, various modifications may be made to these details within the scope of equivalents of the claims and without departing from the spirit of the present disclosure.

The directional descriptions such as "front", "rear", "upper" and "lower" mentioned herein are only for convenience of understanding. The present disclosure is not limited to these directions, but may be adjusted according to the actual situations.

First, referring to FIG. 1, an exploded view of the showerhead in accordance with the present disclosure is shown.

As shown in the figures, the showerhead according to the present disclosure includes an upper body 70, a lower body 10, and an upper decorative cover 100, which all are disk-shaped. A screw 90 passes through a hole in the upper body and is connected to a screw connection part on the lower body 10 (see FIGS. 2 and 3), to assemble the upper body 70 and the lower body 10 together. A sealing washer 80 forms a watertight seal at a junction of the screw 90 and the upper body 70. A gasket 20 for the lower body is provided at the junction of the upper body 70 and the lower body 10 to form a watertight seal. The upper decorative cover 100 covers the upper surface of the upper body 70 to form upper appearance of the showerhead.

A sealed accommodation space is formed between the upper body 70 and the lower body 10. A spring 30, a water outlet plug 40, a fitting plate 50, and a connector 60 are provided inside the accommodation space. The upper body 70 is provided with a water inlet for supplying the water into the accommodation space.

The fitting plate 50 is the disk-shaped and is similar in area to the upper body 70 and the lower body 10, and is movable up and down within the accommodation space. The spring 30 is disposed between the fitting plate 50 and the lower body 10, to bias the fitting plate 50 toward the upper body 70.

The connector 60 includes an enlarged diameter portion 61, which has a diameter larger than that of a hole 51 in the fitting plate 50; a plurality of elastic clamps 62, which are disposed on one side of the enlarged diameter portion 61 and are capable to be inserted through the hole 51 from one side of the fitting plate 50 by elastic contraction and engaged on the other side of the fitting plate 50; and a joint 63, which is disposed on the other side of the enlarged diameter portion 61 to connect the water outlet plug 40.

The connector 60 passes through the fitting plate hole 51 in the fitting plate 50 to snap onto the fitting plate 50. It should be noted that the connector 60 and the fitting plate 50 are not fixedly connected with each other but have a certain gap therebetween. That is, a snap mating portion 64 is formed between the enlarged diameter portion 61 and the elastic clamp 62, and the snap mating portion 64 is snapped to the fitting plate. The height of the snap mating portion 64 is greater than the thickness of the fitting plate 50 such that the connector 60 forms a clearance fit with the fitting plate 50 in a direction of water flow, and the connector 60 is movable up and down with respect to the fitting plate 50. An outer diameter of the snap mating portion 64 is matched with an inner diameter of the fitting plate hole 51, and the outer diameter of the snap mating portion 64 is smaller than the inner diameter of the fitting plate hole 51 such that the connector 60 forms a clearance fit with the fitting plate 50 in a direction perpendicular to the water flow, so that the connector 60 may be movable left and right with respect to the fitting plate 50. The water outlet plug 40 and the connector 60 are collectively referred to as an insert fitting member, which corresponds to the water outlet 11 of the lower body 10. The water outlet plug 40 is connected to the lower end of the connector 60 and can be fitted into the water outlet 11 of the lower body 10 (see FIGS. 2 and 3). The lower body 10 on one side close to the fitting plate 50 is fixedly provided with bosses 15 corresponding to the water outlets 11 respectively. The boss 15 is provided with a through hole in communication with the water outlet 11, and the diameter of the through hole is greater than or equal to the diameter of the water outlet 11. The upper end surface 151 of the boss 15 is perpendicular to an axis of the water outlet 11, such that the connector 60 and the water outlet plug 40 are coaxially engaged with the water outlet 11 when the enlarged diameter portion 61 of the connector 60 abuts against the upper end surface 151 of the boss 15.

It is appreciated for those skilled in the art that the structure of the foresaid components is merely exemplary, and the present disclosure may be accomplished in various manners. For example, the upper body 70 and the lower body 10 may have a circular disk shape or a polygonal shape, and may be connected through, for example, welding, bonding, and shape matching as long as a sealed accommodating space can be formed. The shape of the fitting plate 50 may be designed to be identical to or different from the shape of the upper body 70 and the lower body 10, depending on the actual situation.

The upper body 70 has a tubular portion 71 at its center. The tubular portion projects upward from the upper surface of the upper body 70, and has a hollow portion penetrating through the upper body 70, such that the water supply is communicated with the accommodation space through the hollow portion. A threaded portion is provided on the outer circumference of the tubular portion 71.

Still refereeing to FIG. 1, the showerhead in accordance with the present disclosure also has a water outlet body 110, a pusher 120, a ball joint washer 130, a ball joint 140, a bushing 150, a screen gasket 170, and a showerhead nut 180.

The water outlet body 110 is positioned in the tubular portion 71, presented in a tubular shape and has a water outlet groove 111 on its side wall. The water outlet groove 111 forms a water inlet for supplying water into the accommodation space. The pusher 120 is positioned in the water outlet body 110, the pusher 120 opens the water outlet groove 111 when the water is supplied, and the pusher 120 closes the water outlet groove 111 when the water is turned off.

The ball joint washer 130, the ball joint 140, the bushing 150, and the screen gasket 170 form a water supply structure of the showerhead. The showerhead nut 180 is attached to the external thread of the tubular portion 71 of the upper body 70, thereby the upper decorative cover 100, the water outlet body 110, the ball joint washer 130, the ball joint 140, the bushing 150, and the screen gasket 170 are compressed and held in place.

Figure 2:
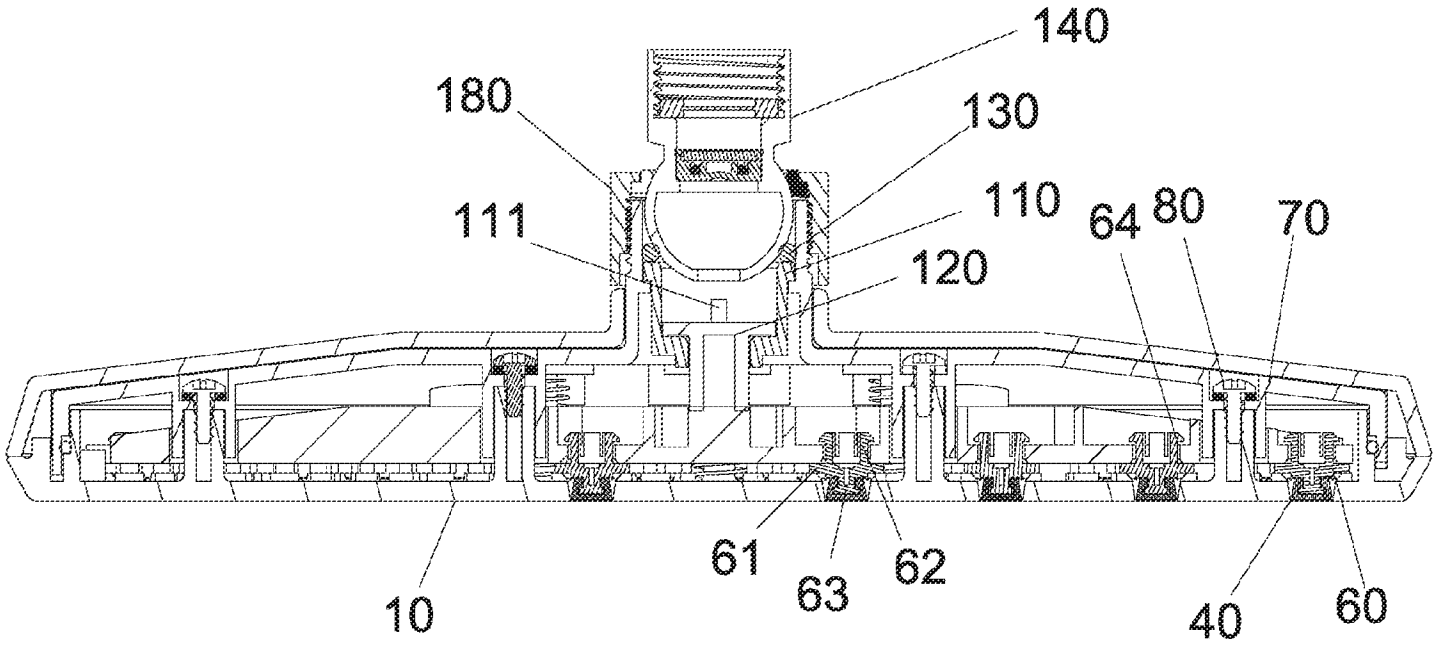
FIG. 2 is a cross-sectional view of the showerhead in accordance with the present disclosure, wherein the water is supplied.
Figure 3:
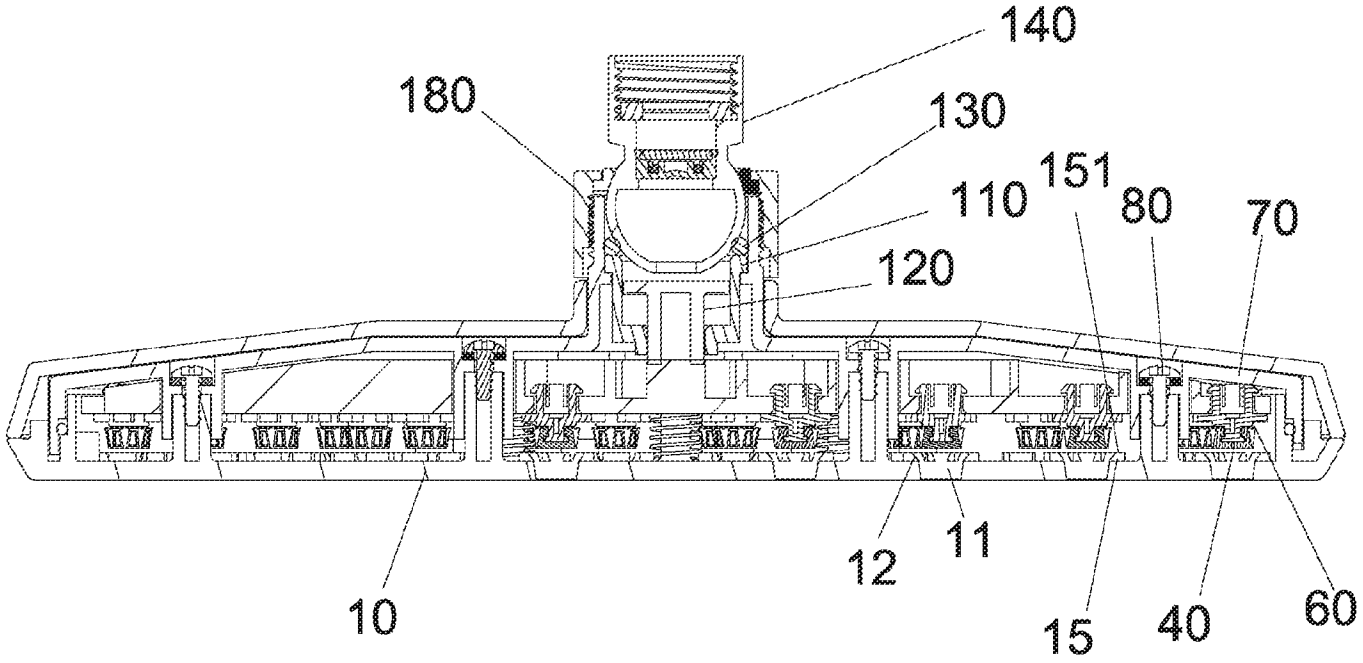
FIG. 3 is a cross-sectional view of a showerhead in accordance with the present disclosure, wherein the water is turned off.

Operation of the showerhead according to the present disclosure will be described below with reference to FIGS. 2 and 3. FIG. 2 is a cross-sectional view of the showerhead in accordance with the present disclosure, wherein the showerhead is in a water-supplying state. FIG. 3 is a cross-sectional view of the showerhead in accordance with the present disclosure, wherein the showerhead is in a water-turning off state.

As shown in FIG. 2, when water is supplied, the water flows from an opening in the lower portion of the ball joint 140 into the water outlet body 110. As the water pressure acts on the top of the pusher 120, the pusher thusly applies a thrust force to the fitting plate 50, to move the fitting plate 50 downward against the bias of the spring 30, so as to and reach its lower position.

It should be noted that the water outlet groove 111 of the water outlet body 110 is not yet exposed to the ball joint 140 (i.e., the water outlet groove 111 is blocked by the pusher 120), when the showerhead is initially supplied with water and has a small water flow rate. Therefore, the water flow cannot reach the accommodation space between the upper body 70 and the lower body 10 through the water outlet body 110, but being accumulated on the upper surface of the pusher 120. As a result, even if the water stream has a small flow rate, sufficient pressure may be generated through the water accumulated on the pusher 120, such that the pusher 120 may move downwardly.

When the pusher 120 is moving downwardly, the water outlet groove 111 of the water outlet body 110 is gradually exposed to the ball joint 140, such that the water flows from the ball joint 140 through the water outlet body 110 to the accommodation space between the upper body 70 and the lower body 10.

At this time, the connector 60, on the one hand, is carried downwardly by the fitting plate 50 because of being fitted to the fitting plate 50; on the other hand, the connector 60 is designed to receive the pressure of the water flow, such that the connector 60 moves downwardly under the action of the water pressure. Due to the clearance fitting formed between the connector 60 and the fitting plate 50 in the direction of the water flow, the enlarged portion 61 abuts against the boss 15 under the action of the water flow, such that the water outlet plug 40 may be completely inserted into and matched with the water outlet 11, to form a uniform water spray. And the plug may be completely inserted into the water outlet 11 even if the fitting plate 50 is bent to be deformed. It is turned due to the downward movement of the connector 60 that the water outlet plug 40 attached to the end of the connector 60 is fitted into the water outlet 11 of the lower body 10. For the structure of the water outlet plug 40, the water outlet plug 40 may be fitted into the water outlet 11 easily and stably even if there is a manufacturing tolerance or an influence from the water flow. The specific structure of the water outlet plug 40 will be explained in detail later.

When the water outlet plug 40 is fitted into the water outlet 11, the water outlet 11 is defined as a fine water outlet passage with special properties, thereby forming a drizzle-type water flow and increasing the user's bathing experience.

Now, returning to FIG. 3. When the water is turned off, the water no longer flows from the ball joint 140 into the water outlet body 110, the water pressure no longer acts on the pusher 120, and the pusher 120 no longer applies thrust force to the fitting plate 50. As a result, the fitting plate 50 moves upwardly to its upper position under the action of the bias of spring 30. At this time, since the connector 60 is engaged to the fitting plate 50, the connector 60 is driven upwardly, such that the water outlet plug 40 also moves upwardly and leaves the water outlet 11 of the lower body 10.

The springs 30 are provided in plural, which may be uniformly arranged circumferentially around the center of the showerhead.

Since the water outlet plug is no longer fitted into the water outlet 11, the water outlet 11 is restored to a complete water outlet. At this time, the water accumulated in the accommodation space will quickly and considerably flow through the water outlet 11, which thereby effectively removes impurities and achieves a cleaning effect.

Figure 4:
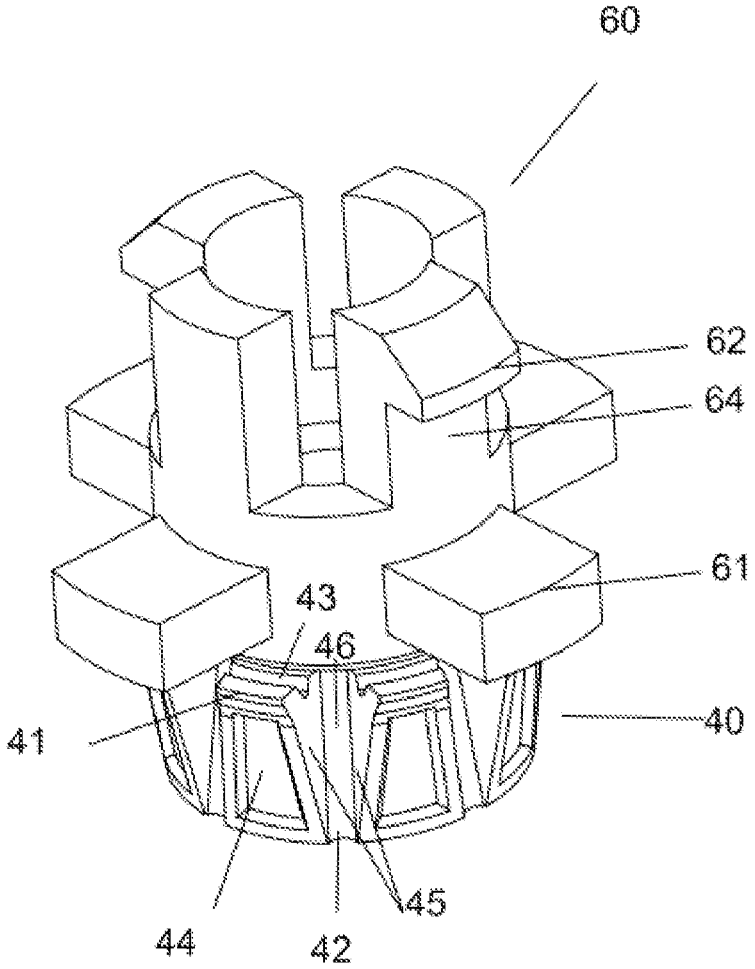
FIG. 4 is an enlarged perspective view of a water outlet plug of a showerhead in accordance with the present disclosure.
Figure 5:
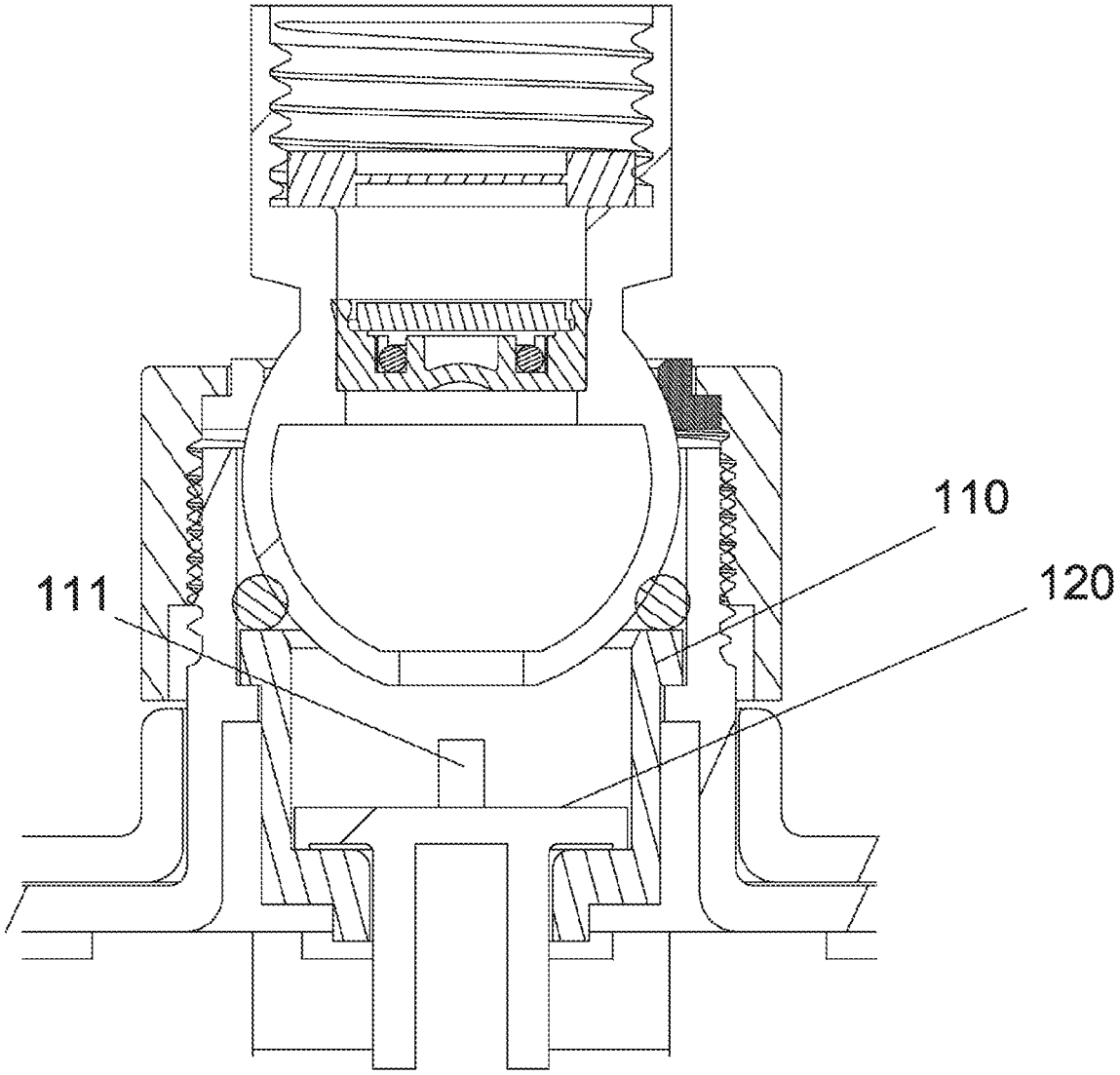
FIG. 5 is an enlarged cross-sectional view of a water outlet body and a pusher of the showerhead in accordance with the present disclosure.

Now returning to FIG. 4, an enlarged perspective view of the water outlet plug 40 of the showerhead in accordance with the present disclosure is shown.

As shown in the figures, the water outlet plug 40 has an approximately truncated cone shape gradually tapered to the water outlet 11, and has a larger diameter end and a smaller diameter end. The larger diameter end of the water outlet plug 40 is connected to the lower end of the connector 60 and has a diameter larger than that of the lower end of the connector 60. As a result, an annular portion of the upper surface of the water outlet plug 40 exposes to the outside of the connector 60.

The water outlet plug 40 includes a plurality of longitudinal grooves 42 and a plurality of circumferential grooves 43. The longitudinal grooves 42 extend through the entire height of the water outlet plug 40 to define passages through which the water flows. Each of the longitudinal grooves 42 has straight side walls (45) and a rounded bottom wall (46). At the connection interface of the water outlet plug 40 and the connector 60, the bottom of the longitudinal groove 42 is flush with the outer surface of the connector 60. The circumferential grooves 43 are located at the larger diameter end of the water outlet plug 40 and recessed downward. More specifically, the circumferential grooves 43 are located near the middle of the above-mentioned annular portion of the larger diameter end of the water outlet plug. The circular groove 43 has a trapezoidal cross section. The circumferential grooves 43 are interrupted by the longitudinal grooves 42, so that a complete annular groove around the water outlet plug 40 is not formed. The water flow on the circumferential groove 43 acts on the circumferential groove 43, such that the water outlet plug 40 is subjected to a downward pressure of the water during its downward movement.

There is a lip 41 protruding outwardly in the radial direction at the larger diameter end of the water outlet plug 40. The lip 41 has a triangular radial cross section. The upper edge of the triangle is flush with the upper surface of the water outlet plug, the inner edge is integrated with the water outlet plug 40, and the outer edge forms an outward inclined angle relative to the side surface of the water outlet plug 40. The lip 41 is interrupted by the longitudinal groove 42, so that a complete annular lip around the water outlet plug 40 is not formed. The lip 41 is elastically matched with the circumferential groove 43, and the lip 41 may be elastically deformed towards the circumferential groove 43 under the action of an external force. The lip 41 may be elastically deformed towards the circumferential groove 43 during the downward movement of the water outlet plug 40, such that the lip 41 can be sealed by the inner surface of the water outlet 11. It has an advantage that the water only flows out of the longitudinal groove 42, with even and complete water spray and without splashing. At the same time, the water outlet plug 40 may move into place under low pressure, since the water outlet plug is subjected to less friction force during the downward movement because of inwardly and elastically deformation of the lip 41.

There is an outwardly inclined enlarged portion 12 at the upper edge of the water outlet 11 of the lower body 10 has. When the water outlet plug 40 is fitted into the water outlet 11, the lip 41 of the water outlet plug 40 slides in and is fitted into the water outlet 11 via the enlarged portion 12.

Due to the above structure of the water outlet plug 40 and the water outlet 11, even if there is a certain manufacturing tolerance, or under the influence of the water flow, the water outlet plug 40 may smoothly slide into the water outlet 11 and form a stable cooperation to define a water flow passage as desired and ensure well user's experience.

The diameter of the water outlet 11 at the central position of the lower body 10 is larger than the diameter of the water outlet 11 at other positions of the lower body 10. The size of the water outlet plug 40 is designed d to correspond to the size of the water outlet 11.

While the preferred embodiments have been illustrated and described herein, it is understood that the embodiments are given by way of examples only. Modifications, changes and substitutions will be apparent to those skilled in the art without departing from the spirit of the present disclosure.

Therefore, the appended claims are intended to cover all such modifications that fall within the spirit and scope of the present disclosure.

What is claimed is:

1. A showerhead comprising:

a body, including an upper body (70) and a lower body (10), the upper body (70) and the lower body (10) forming an accommodation space, and a water inlet for supplying water into the accommodation space being provided at the upper body (70), a plurality of water outlets (11) for spraying water from the showerhead being provided on the lower body (10);

wherein the showerhead further comprises:

a fitting plate (50) located in the accommodation space and being movable up and down along a direction of a water flow in the accommodation space;

a spring (30) disposed between the fitting plate (50) and the lower body (10), for applying a force to the fitting plate (50) away from the lower body (10);

an insert fitting member fitted to the fitting plate (50), a position of the insert fitting member corresponding to the plurality of water outlets (11) on the lower body (10);

wherein the insert fitting member comprises a connector (60) and a water outlet plug (40);

wherein the water outlet plug (40) has an approximately truncated cone shape gradually tapered toward the water outlet (11), a larger diameter end and a smaller diameter end, and a lip (41) radially projecting outward at the larger diameter end;

wherein the lip (41) forms a circumferential groove (43) with the larger diameter end, and the circumferential groove (43) is located on an end surface of the larger diameter end, recessed toward the smaller diameter end, and evenly distributed along the circumferential direction of the water outlet plug (40);

when the water is supplied, the fitting plate (50) moves to a lower position under the action of water pressure to allow the water outlet plug (40) of the insert fitting member to partially close the water outlet (11) such that a drizzle-type spray is formed; when the water is turned off, the spring pushes the fitting plate (50) back to the upper position, and the water outlet plug (40) leaves the water outlet (11).

2. The showerhead according to claim 1, wherein:

the connector (60) is engaged on the fitting plate (50) in a non-fixed manner and is movable up and down, left and right relative to the fitting plate (50);

when the water is supplied, the connector (60) abuts downwardly against the lower body (10) under the action of water pressure, such that the water outlet plug (40) is completely inserted into the water outlet (11).

3. The showerhead according to claim 2, wherein:

the fitting plate (50) has a plurality of holes (51) penetrating up and down for placing the plurality of connectors (60);

each of the connectors (60) comprises:

an enlarged diameter portion (61) having a diameter greater than a diameter of the hole (51) in the fitting plate (50);

a plurality of elastic clamps (62) disposed on one side of the enlarged diameter portion (61), capable of being inserted through the hole (51) from one side of the fitting plate (50) through elastic contraction and being engaged on the other side of the fitting plate (50); and a joint (63) disposed on the other side of the enlarged diameter portion (61), for connecting the water outlet plug (40).

4. The showerhead according to claim 2, wherein:

the water outlet plug (40) comprises:

a plurality of longitudinal grooves (42) uniformly distributed circumferentially along the water outlet plug (40), and each of the longitudinal grooves (42) extends from the larger diameter end to the smaller diameter end to define a passage through which the water flows.

5. The showerhead according to claim 4, wherein:

the longitudinal groove (42) has two straight side walls (45) and a concave arc-shaped rounded bottom wall (46).

6. The showerhead according to claim 1, wherein:

the size of the water outlet plug (40) is designed to correspond to the size of the water outlet (11).

7. The showerhead according to claim 1, wherein the showerhead further comprises:

a pusher (120) mounted inside the body to close and open the water inlet;

wherein the fitting plate (50) is disposed adjacent to the lower body (10) with respect to the pusher (120), and is capable of abutting against the pusher (120);

when the water is supplied, the pusher (120) opens the water inlet under the action of the water pressure, and the fitting plate (50) moves to the lower position under the action of the pusher (120); when the water is turned off, the spring pushes the fitting plate (50) back to the upper position, the water outlet plug (40) leaves the water outlet (11), and the pusher (120) is pushed back to close the water inlet.

8. The showerhead according to claim 7, wherein:

the upper body (70) has a hollow tubular portion (71) at a central position thereof, and the tubular portion (71) leads to the accommodation space.

9. The showerhead according to claim 8, wherein:

the showerhead further comprises a water outlet body (110) located in the tubular portion (71), the water outlet body (110) in a tubular shape has a water outlet groove (111) on a side wall thereof, and the water outlet groove (111) forms a water inlet for supplying the water into the accommodation space;

the pusher (120) is located in the water outlet body (110), the pusher (120) opens the water outlet groove (111) when the water is supplied, and the pusher (120) closes the water outlet groove (111) when the water is turned off.

* * * * *